US006994281B2

(12) United States Patent
Reiter

(10) Patent No.: US 6,994,281 B2
(45) Date of Patent: Feb. 7, 2006

(54) FUEL INJECTOR

(75) Inventor: Ferdinand Reiter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 174 days.

(21) Appl. No.: 10/362,399

(22) PCT Filed: May 25, 2002

(86) PCT No.: PCT/DE02/01927

§ 371 (c)(1),
(2), (4) Date: Jul. 25, 2003

(87) PCT Pub. No.: WO03/001051

PCT Pub. Date: Jan. 3, 2003

(65) Prior Publication Data

US 2004/0099753 A1 May 27, 2004

(30) Foreign Application Priority Data

Jun. 22, 2001 (DE) ..... 101 30 205

(51) Int. Cl.
*F02M 59/00* (2006.01)
*F02M 39/00* (2006.01)
*B05B 1/30* (2006.01)

(52) U.S. Cl. ..... 239/533.2; 239/533.9; 239/575; 239/585.3; 239/585.5

(58) Field of Classification Search ..... 239/533.2, 239/533.3, 533.9, 584, 575, 88–93, 585.1–585.5, 239/533.11, 533.13; 251/129.21, 129.15, 251/127

See application file for complete search history.

(56) References Cited

U.S. PATENT DOCUMENTS

| | | | | | |
|---|---|---|---|---|---|
| 5,190,223 | A | * | 3/1993 | Mesenich | 239/585.5 |
| 5,238,192 | A | | 8/1993 | McNair | |
| 5,325,838 | A | * | 7/1994 | Bennett | 123/527 |
| 5,423,489 | A | | 6/1995 | Wood | |
| 6,003,791 | A | | 12/1999 | Reiter | |
| 6,363,915 | B1 | * | 4/2002 | Cohen | 123/467 |

FOREIGN PATENT DOCUMENTS

| | | |
|---|---|---|
| DE | 44 21 881 | 1/1996 |
| JP | 42 00 710 | 5/1993 |

* cited by examiner

*Primary Examiner*—Davis Hwu
(74) *Attorney, Agent, or Firm*—Kenyon & Kenyon

(57) ABSTRACT

A fuel injector for fuel-injection systems of internal combustion engines includes a valve needle cooperating with a valve-seat surface to form a sealing seat, and an armature engaging with the valve needle, the armature being axially moveable at the valve needle and being damped, via a damping element, which is located in a recess in a downstream-side end face of the armature, with respect to a cup-shaped sleeve positioned downstream from the armature and joined to the valve needle in force-locking manner. Furthermore, the fuel injector includes a filter element, the filter element being positioned downstream from the armature in the cup-shaped sleeve.

12 Claims, 2 Drawing Sheets

FUEL INJECTOR

FIELD OF THE INVENTION

The present invention is directed to a fuel injector.

BACKGROUND INFORMATION

German Patent No. 44 21 881 (DE 44 21 881 A1) discusses a fuel injector having a valve needle with a filter element mounted thereon or inside of it. The filter element is used to keep any particles and impurities, upstream from the sealing seat in the interior of the fuel injector, away from the sealing seat, thereby avoiding clogging and/or leakages at the sealing seat. The filter element is designed in the form of a screening sock which envelops the valve needle at least partially.

The fuel injector discussed in DE 44 21 881 A1 is such that the production and installation of a sock-shaped filter element may be complex and, thus, cost-intensive. Because of the large surface of the filter element, it is susceptible to twisting and shifting during the operation of the fuel injector, due to considerable valve-needle movement.

SUMMARY OF THE INVENTION

In contrast, the fuel injector of the present invention has the advantage over the related art that, in addition to a filter element positioned in the fuel feed, an additional filter element is provided which is located downstream from the armature. It allows either a second, finer filtering of the fuel flowing through in addition to the filtering by the first filter element, or replacing the first filter element, which has the advantage of allowing a shorter length for the fuel injector.

It is believed that it is advantageous in this context that the second filter element is able to be produced in a simple manner from a screen mesh or by introducing orifices into an annular sheet metal. The opening may be produced in a variety of ways, such as laser drilling, etching, eroding or stamping.

It is believed that it is also advantageous that the filter element may either be loosely placed into the sleeve positioned downstream from the armature, or be braced against it or welded to it, thereby holding the filter element in place.

An advantageous, additional arrangement for fixation is offered by a concave, convex or dish-like form of the filter element, since in this case a fixation is possible by axial bracing between the armature and the sleeve, which may be biased relative to one another for damping purposes, without requiring additional fixation measures, yet providing excellent accuracy of fit.

DETAILED DESCRIPTION

Figure 1:
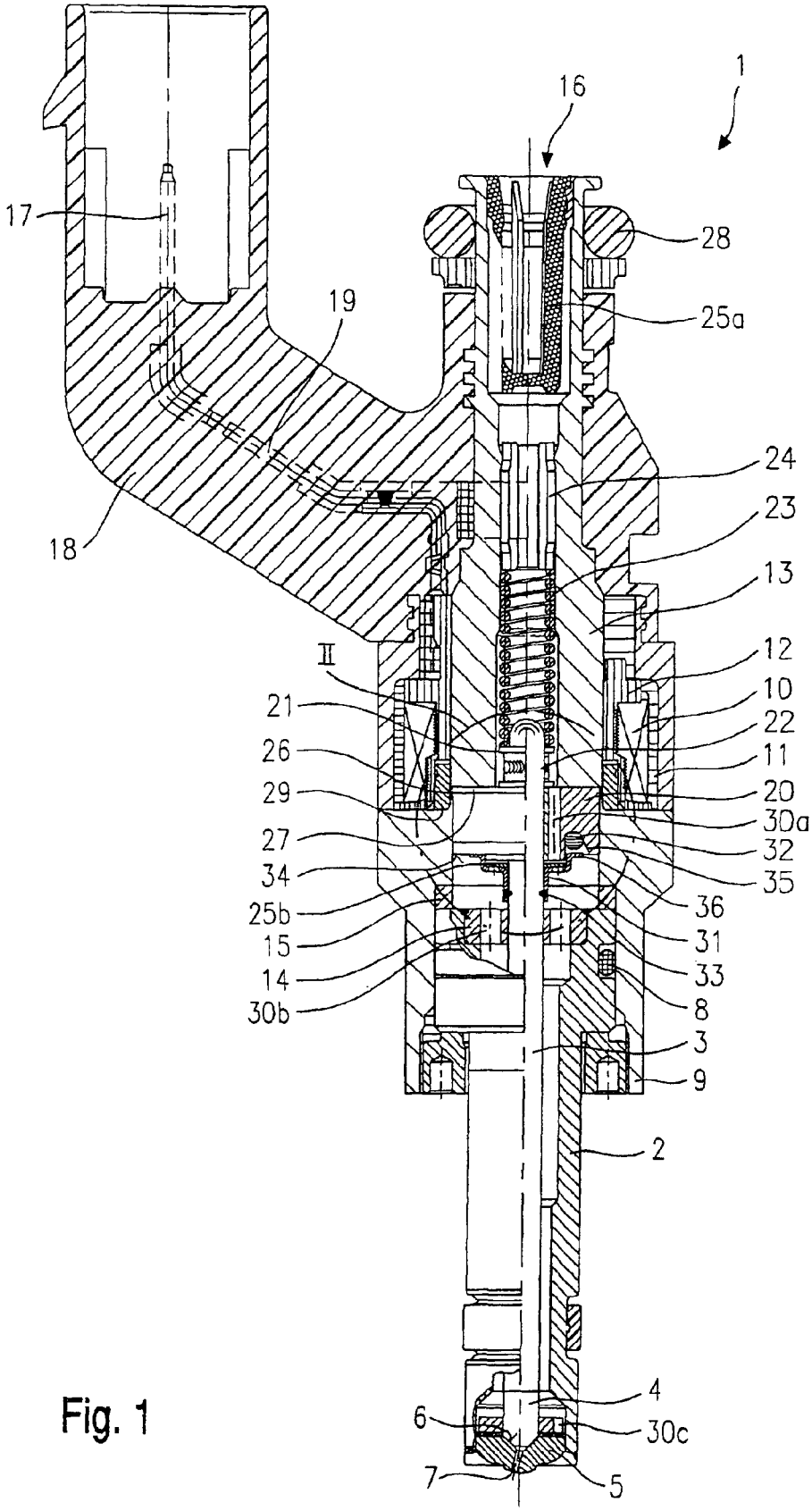
FIG. 1 is a schematic section of an exemplary embodiment of a fuel injector configured according to the present invention in an overall view.

A fuel injector 1, shown in FIG. 1, is designed in the form of a fuel injector for fuel-injection systems of mixture-compressing internal combustion engines having externally supplied ignition. Fuel injector 1 is particularly suited for the direct injection of fuel into a combustion chamber (not shown) of an internal combustion engine.

Fuel injector 1 includes a nozzle body 2 in which a valve needle 3 is positioned. Valve needle 3 is in operative connection with a valve-closure member 4, which cooperates with a valve-seat surface 6 situated on a valve-seat member 5 to form a sealing seat. In the exemplary embodiment, fuel injector 1 is an inwardly opening fuel injector 1, which has one spray-discharge orifice 7. Seal 8 seals nozzle body 2 from an outer pole 9 of a magnetic coil 10. Magnetic coil 10 is encapsulated in a coil housing 11 and wound on a coil brace 12, which rests against an inner pole 13 of magnetic coil 10. Inner pole 13 and outer pole 9 are separated from each other by a constriction 26 and joined to one another by a non-ferromagnetic connecting part 29. Magnetic coil 10 is energized via a line 19 by an electric current, which may be supplied via an electrical plug contact 17. A plastic coating 18, which may be extruded onto inner pole 13, encloses plug contact 17.

Valve needle 3 is guided in a valve-needle guide 14, which is disk-shaped. A paired adjustment disk 15 adjusts the (valve) lift. On the other side of adjustment disk 15 is an armature 20. It is connected by force-locking to valve needle 3 via a flange 21, and valve needle 3 is connected to flange 21 by a welded seam 22. A restoring spring 23, which, in the present design of fuel injector 1, is prestressed by a sleeve 24, is braced against flange 21. Fuel channels 30*a* through 30*c* run through valve needle guide 14, armature 20 and valve seat member 5, conducting the fuel, supplied via central fuel supply 16 and filtered by a first filter element 25*a*; to spray-discharge opening 7. Seal 28 seals fuel injector 1 from a fuel line (not shown further).

Positioned at a downstream side 34 of armature 20 in a recess 35 is a damping element 32 designed as an O-ring, which is made of an elastomeric material. It rests against a shoulder-type broadened region 36 of a deep-drawn sleeve 31, which is joined to valve needle 3 in a force-locking manner via a welding seam 33.

Positioned in deep-drawn sleeve 31 is a second filter element 25*b*, which is designed as a flat filter 25 and may be made, for instance, from screen mesh or have the form of a disk provided with many small orifices.

Formed in sleeve 31 are flow-through orifices 37 which are covered by second filter element 25*b*, which, it is believed, protect the valve seat from contamination by coarse particles in the fuel and preventing malfunctions of fuel injector 1.

In the resting state of fuel injector 1, restoring spring 23 acts upon armature 20, counter to its lift direction, in such a way that valve-closure member 4 is sealingly held at valve seat 6. Upon excitation of magnetic coil 10, it generates a magnetic field which moves armature 20 in the lift direction, counter to the spring force of return spring 23, the lift being predefined by a working gap 27 existing in the neutral position between inner pole 12 and armature 20. Flange 21, which is welded to valve needle 3, is moved by armature 20 in the lift direction as well. Valve-closure member 4, which is connected to valve needle 3, lifts off from valve seat surface 6, so that the fuel is spray-discharged through spray-discharge orifice 7.

In response to the coil current being switched off, after sufficient decay of the magnetic field, armature 20 falls away from inner pole 13 due to the pressure of return spring 23, so that flange 21, being connected to valve needle 3, moves in a direction counter to the lift. As a result, valve needle 3 is moved in the same direction, causing valve-closure member 4 to set down upon valve seat surface 6 and fuel injector 1 to be closed.

Figure 2:
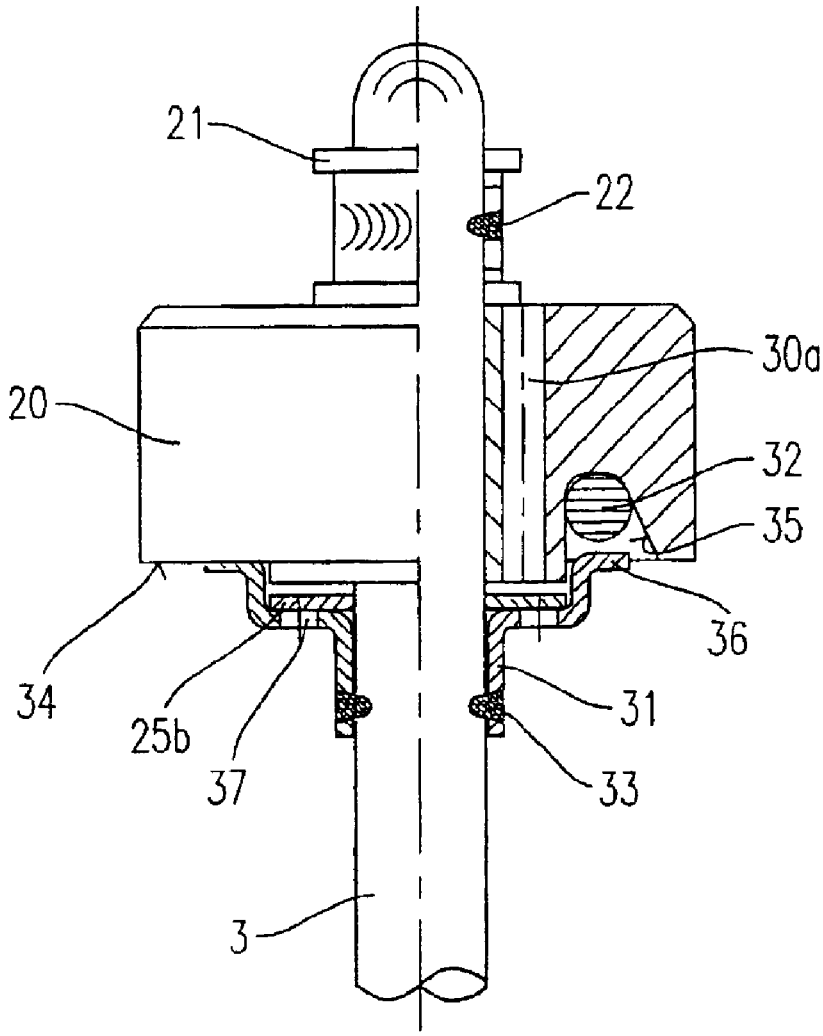
FIG. 2 is a schematic section through the exemplary embodiment, shown in FIG. 1, of a fuel injector designed according to the present invention, in region II in FIG. 1.

FIG. 2 shows a part-sectional view of region II in FIG. 1 in an enlarged view.

As shown in FIG. 2, a segment of valve needle 3, flange 21 welded thereto, sleeve 31 and second filter element 25*b* are configured according to the present invention and inserted into recess 35 of armature 20.

When assembling the component made up of armature 20 and valve needle 3, flange 21 may be first welded to valve needle 3 via welding seam 22. Damping element 32 is inserted into recess 35 formed in discharge-side end face 34 of armature 20, and armature 20; with damping element 32 inserted, is slipped over valve needle 3. Then, second filter element 25*b* is inserted into sleeve 31 having a stepped design and which is may be produced by deep-drawing and provided with stamped flow-through orifices 37 towards the fuel feed. Sleeve 31, together with second filter element 25*b*, is then slipped over valve needle 3 and joined to valve needle 3 via a welded seam 33 as well.

Second filter element 25*b* is positioned such that it covers flow-through orifices 37 in cup-shaped sleeve 31. The form and fit of armature 20 ensure that fuel is only able to flow through fuel channels 30*a* in the armature and flow-through orifices 37 in sleeve 31 in the direction of the sealing seat. In this way, using second filter element 25*b* inserted in sleeve 31, in addition to first filter element 25*a* positioned in central fuel feed 16, it is possible to filter out coarse particles in the fuel, thereby protecting the sealing seat from impurities which may lead to malfunctions of fuel injector 1.

Second filter element 25*b* may be configured in the form of a flat filter 25*b*, which may be produced from screen mesh. Second filter element 25*b* may also be produced as a disk from thin sheet metal and be provided with round or longitudinal orifices through which the fuel flows. The orifices may be produced by stamping, eroding, etching or laser-drilling. The orifices may be smaller than the orifices of upstream first filter element 25*a*, thereby increasing the effectiveness of the fuel filtering.

Second filter element 25*b* may be fixed in position inside sleeve 31 in different ways to avoid movement and subsequent entry of dirt particles into the fuel flow.

If second filter element 25*b* is dimensioned such that its diameter corresponds to the inside width of sleeve 31, it may be inserted into cup-shaped sleeve 31 without being fixed in place. If second filter element 25*b* has a slightly larger dimension, it may be pressed into sleeve 31 by radial pressing.

However, a simpler installation is possible if second filter element 25*b* is somewhat smaller than sleeve 31. In this case, second filter element 25*b* can be fixed in position on sleeve 31 by laser tack-welding or spot welding using at least one spot.

In an alternate configuration, for instance, a configuration using a plate-shaped or arched filter element 25*b*, an axial bracing of filter element 25*b* between armature 20 and sleeve 31 may be considered as well. It is believed that this may be advantageous, in particular, because armature 20 is braced against sleeve 31 for damping purposes anyway.

The present invention is not limited to the exemplary embodiment shown, but is also suited, for instance, for outwardly opening fuel injectors 1 and other armature configurations, such as flat-type armatures.

What is claimed is:

1. A fuel injector for a fuel injection system of an internal combustion engine, comprising:

a valve seat surface;

a valve needle which cooperates with the valve seat surface to form a sealing seat;

an armature including a downstream-side end face having a recess, and axially engaging the valve needle;

a damping element situated in the recess of the armature;

a cup-shaped sleeve situated downstream from the armature and joined to the valve needle by force-locking using the damping element, wherein the armature is damped with respect to the cup-shaped sleeve; and a filter element positioned downstream from the armature in the cup-shaped sleeve.

2. The fuel injector of claim 1, wherein the filter element includes a flat filter.

3. The fuel injector of claim 2, wherein the filter element includes a screen mesh.

4. The fuel injector of claim 2, wherein the filter element includes a disk including orifices.

5. The fuel injector of claim 4, wherein the orifices of the filter element are one of round and longitudinal.

6. The fuel injector of claim 4, wherein the orifices are produced by one of stamping, eroding, etching and laser-drilling.

7. The fuel injector of claim 4, wherein the orifices of the filter element positioned in the cup-shaped sleeve are smaller than the orifices of a filter element positioned in a central fuel feed.

8. The fuel injector of claim 1, wherein the filter element is loosely inserted in the cup-shaped sleeve.

9. The fuel injector of claim 1, wherein the filter element is radially compressed in the cup-shaped sleeve.

10. The fuel injector of claim 1, wherein the filter element is fixed in place inside the cup-shaped sleeve by a weld.

11. The fuel injector of claim 1, wherein the filter element is axially braceable between the armature and the cup-shaped sleeve.

12. The fuel injector of claim 1, wherein the cup-shaped sleeve includes flow-through orifices that are covered by the filter element.

* * * * *